US008062711B2

(12) United States Patent
Löfgren et al.

(10) Patent No.: US 8,062,711 B2
(45) Date of Patent: Nov. 22, 2011

(54) DEVICE AND A METHOD FOR STABILIZING A STEEL SHEET

(75) Inventors: Peter Löfgren, Västerås (SE); Jan-Erik Eriksson, Västerås (SE); Mats Molander, Västerås (SE); Carl-Fredrik Lindberg, Västerås (SE); Conny Svahn, Västerås (SE)

(73) Assignee: ABB Research Ltd., Zürich (CH)

( * ) Notice: Subject to any disclaimer, the term of this patent is extended or adjusted under 35 U.S.C. 154(b) by 598 days.

(21) Appl. No.: 11/886,946

(22) PCT Filed: Mar. 23, 2006

(86) PCT No.: PCT/SE2006/000368

§ 371 (c)(1),
(2), (4) Date: Jan. 5, 2009

(87) PCT Pub. No.: WO2006/101446

PCT Pub. Date: Sep. 28, 2006

(65) Prior Publication Data

US 2009/0175708 A1 Jul. 9, 2009

(30) Foreign Application Priority Data

Mar. 24, 2005 (SE) ..... 0500716

(51) Int. Cl.
*B05D 1/18* (2006.01)
*B05C 3/12* (2006.01)

(52) U.S. Cl. ..... 427/433; 427/436; 118/400; 118/419; 118/427

(58) Field of Classification Search ..... 427/430.1, 427/431, 434.2, 435
See application file for complete search history.

(56) References Cited

U.S. PATENT DOCUMENTS

| | | | | |
|---|---|---|---|---|
| 3,784,072 | A | 1/1974 | Armstrong et al. | |
| 6,471,153 | B1 * | 10/2002 | Kimura et al. | 242/419.3 |
| 2003/0077397 | A1 * | 4/2003 | Kabeya et al. | 427/431 |
| 2005/0115052 | A1 * | 6/2005 | Takahashi et al. | 29/527.7 |

FOREIGN PATENT DOCUMENTS

| | | | |
|---|---|---|---|
| JP | 5245521 | A | 9/1993 |
| JP | 8010847 | A | 1/1996 |
| JP | 08010847 | A * | 1/1996 |
| JP | 9202955 | A | 8/1997 |
| JP | 10053852 | A * | 2/1998 |
| JP | 2000345310 | A | 12/2000 |
| WO | WO 2004024974 | A1 * | 3/2004 |

OTHER PUBLICATIONS

PCT/ISA/210—International Search Report—Jun. 30, 2006.
PCT/IPEA/409—International Preliminary Report on Patentability—Mar. 22, 2007.

* cited by examiner

*Primary Examiner* — David Turocy
(74) *Attorney, Agent, or Firm* — Venable LLP; Eric J. Franklin

(57) ABSTRACT

A device for stabilizing an elongated steel sheet when continuously transporting the steel sheet in a transport direction along a predetermined transport path. The device includes at least a first pair, a second pair and a third pair of electromagnets with at least one electromagnet on each side of the steel sheet. The electromagnets are adapted to stabilize the steel sheet with respect to the predetermined transport path. The first and second electromagnets are elongated in a direction essentially perpendicular to the transport direction. The first and second electromagnets are substantially arranged on each side of a longitudinal center line for the steel sheet. The center line is essentially parallel to the transport direction. The third electromagnet is arranged adjacent to the center line.

20 Claims, 4 Drawing Sheets

DEVICE AND A METHOD FOR STABILIZING A STEEL SHEET

TECHNICAL FIELD

The present invention relates to a device for stabilizing an elongated steel sheet. The invention also relates to a method for stabilizing an elongated steel sheet.

BACKGROUND ART

During continuous galvanization of a metal sheet, for example a steel sheet, the steel sheet continuously passes through a bath that contains molten metal, usually zinc. In the bath, the sheet usually passes below an immersed roller and then moves upwards through stabilizing and correcting rollers. The sheet leaves the bath and is conveyed through a set of gas-knives, which blow away superfluous zinc from the sheet and back to the bath to control the thickness of the coating. The gas that is blown out with the knives is usually air or nitrogen, but also steam or inert gas may be used. The sheet is then conveyed without support until the coating has been cooled down and solidified. The coated steel sheet is then led or directed via an upper roller for continued treatment of the steel sheet such as, for example, cutting of the sheet into separate sheet elements or for winding the sheet onto a roller. Normally, the sheet moves in a vertical direction away from the roller immersed into the bath through the correcting and stabilizing rollers and the gas-knives to the upper roller.

When steel sheet is galvanized, an even and thin thickness of the coating is aimed at. One common method is to measure the mass of the coating after the sheet has passed through the upper roller. This reading is utilized for controlling the gas-knives and hence controlling the thickness of the coating. The gas-knives are usually arranged suspended from a beam that is movably arranged in the vertical direction and in a direction towards the sheet. The gas-knives may also be angled such that the angle at which the gas hits the coating on the sheet may be changed. Due to the geometry of the steel sheet, the length the sheet has to run without support, its speed and the blowing effect of the gas-knives, however, the steel sheet will move or vibrate in a direction that is essentially perpendicular to its direction of transport. Certain measures, such as the use of correcting and stabilizing rollers, a precise control of the gas flow from the gas-knives, and an adjustment of the speed of the steel sheet and/or an adjustment of the distance over which the sheet has to run without support, may be taken for the purpose of reducing these transversal movements. If they are not reduced, these transversal movements will considerably disturb the exact wiping of the gas-knives, which results in an uneven thickness of the coating.

In the Japanese publication with publication number JP 09-202955, it is shown how the vibrations in a metallic sheet are reduced with the aid of rolls that stabilize and tension the sheet after having passed through the gas-knives. The position of the sheet in relation to its direction of transport in a plane is measured with a sensor, from where information is passed on to a computer that carries out a vibration analysis based on the values obtained and, together with information about the speed of the sheet, calculates the optimum tensioning of the sheet to control the vibrations in the sheet.

It is also known from, inter alia, U.S. Pat. No. 6,471,153 and JP 8010847 A to arrange, in a device for galvanizing a steel sheet, a plurality of electromagnets along the width of the sheet, which generate magnetic forces acting perpendicular to the sheet in order to damp vibrations in the sheet. A sensor measures the distance between the steel sheet and the electromagnet and a control device controls the flow of a current through the electromagnet from the distance measured by the sensor. In case of narrow widths of the sheet, the electromagnets which end up outside the edges of the sheet are shut off as the value measured by the sensors becomes incorrect since, when the electromagnets end up outside the edges of the sheet, there is no sheet between the magnets. This further means that the control Systems for this type of solution will be unnecessarily expensive and complicated. Using many magnets, as described in the above-mentioned documents, also entails increased costs, increased system complexity and a risk of introducing new unwanted oscillations.

There is a need of a cost-effective device and method for stabilizing a steel sheet, wherein the device may be used for several different widths of steel sheet without having to control certain electromagnets when the sheet width is changed.

SUMMARY OF THE INVENTION

The object of the invention is to provide a device intended to stabilize an elongated steel sheet during continuous transport of the steel sheet in a direction of transport along a predetermined transport path, wherein the device may be used for different widths of sheet without having to readjust the plant when the sheet width changes.

This object is achieved with the device described in the introduction, which is characterized in that the first and second electromagnets are formed elongated and arranged in a direction essentially perpendicular to the transport direction, and the first and second electromagnets are substantially arranged on respective sides of a longitudinal centre line for the steel sheet, wherein the centre line is essentially parallel to the transport direction, and the third electromagnet is arranged adjacent to the centre line.

By arranging a first and a second electromagnet on each side of the centre line, a torque may be applied, where necessary, to the sheet to compensate for vibrations, oscillation phenomena, and/or deflection of the sheet. A third electromagnet arranged over the centre line, in cooperation with the first and second electromagnets, provides a possibility of flattening out a statically deformed sheet, since then both horizontal and vertical stabilization of the sheet are obtained, which means that the risk that vibrations will propagate in the vertical direction is essentially reduced.

Using three large elongated magnets is optimal from the point of view that this is the smallest number of magnets that is needed to eliminate the three most serious oscillations modes: translation, rotation and bending. By using elongated magnets, forces are obtained which act on the sheet over a large area, which efficiently damps the oscillations of the sheet. By using elongated magnets, also the problems of a varying sheet width are eliminated, since the magnets will always provide a suitable field strength all the way out to the outer edge of the sheet, for if the sheet width is changed this implies that the magnets, to a greater or lesser extent, will be located outside the edge of the sheet, but a uniform force will still always affect the sheet all the way out to the edge.

Another advantage of the invention is that the centre of force for the outer magnets will always be midway between the inner edge of the magnets and the outer edge of the sheet, irrespective of the sheet width that is run in the plant, which means that a more uniform influence of force on the sheet is obtained so that it does not bend more in the vicinity of the edges of the magnets.

A further advantage of the invention is that the electromagnets may be placed at the same location irrespective of the width of the steel sheet in question, and, furthermore, the same size and design of electromagnets may be used for all the electromagnets in a device for stabilizing a steel sheet.

Additional advantages achieved with this solution is that no magnets need to be controlled if the sheet width varies, which in turn means that a small number of magnets (3) with associated sensors (3) may be used, which implies that the control of the plant will be simpler than with prior art solutions.

Still another advantage is that optimum damping of vibrations and bending of the steel sheet are achieved irrespective of the width of the steel sheet, which entails an improved surface evenness and hence improved quality of the coating, and yet another advantage is that the deviation of the steel sheet from a best possible position becomes minimal.

By a predetermined transport path is meant in the following and in the claims an arbitrary plane that can be determined and changed during the transport of the steel sheet, for example when the width or the shape of the sheet is changed. The shape of the sheet may, for example, vary with the width of the sheet, since when manufacturing the sheet by rolling, the sheet may be subjected to a deformation, usually in the form of a bow.

An electromagnet comprises a core and at least one coil wound around the core. In the following and in the claims, the length of an electromagnet means the length of the core in the electromagnet.

According to one embodiment of the invention, the first and second electromagnets are located in a line with each other and perpendicular to the transport direction. By arranging the first and second electromagnets on respective sides of the centre line, a torque may be applied, where necessary, to both sides of the centre line in order to compensate for vibrations, oscillation phenomena and/or deflection of the sheet.

According to one embodiment of the invention, the third electromagnet is elongated and extends in its longitudinal direction essentially transversely to the transport direction and over the centre line of the steel sheet. A third electromagnet arranged over the centre line gives, in cooperation with the first and second electromagnets, the possibility of flattening out a statically deformed sheet since both a horizontal and a vertical stabilization of the sheet are then obtained, which means that the risk of vibrations propagating in the vertical direction is essentially reduced.

According to an alternative embodiment to the immediately preceding embodiment, the third electromagnet is elongated and extends in its longitudinal direction essentially along the transport direction and adjacent to the centre line of the steel sheet, preferably in the centre line. This design provides a better distribution of forces in the vertical direction, which means that the stabilization of the sheet in the vertical direction is improved.

According to one embodiment of the invention, the third electromagnet is arranged, in the transport direction, upstream or downstream of the first and second electromagnets. This embodiment implies that the location of the third electromagnet is chosen based on what is most appropriate for reasons of enclosure.

According to one embodiment of the invention, the third electromagnet has a length that at least partly overlaps the length of the first and second electromagnets transversely to the transport direction. In this way, all the currently used sheet widths are covered without the device having to be adjusted.

According to one embodiment of the invention, the third electromagnet is elongated and extends in its longitudinal direction essentially along the transport direction and adjacent to the centre line of the steel sheet, preferably in the centre line, and is arranged between the first and second electromagnets. This design provides a better distribution of forces in the vertical direction, thus improving the vertical stabilization of the sheet.

According to one embodiment of the invention, the length of at least one of the electromagnets is in the interval of 300-1000 mm. Preferably, the length of at least one of the electromagnets is in the interval of 400-700 mm. By giving the electromagnets an elongated shape, the same size of electromagnets may be used for most widths of steel sheet and for all electromagnets in the device.

According to one embodiment of the invention, the device is, for example, arranged in a process line for coating steel sheet with a metallic layer, whereby said layer is applied by continuously transporting the sheet through a bath of molten metal, whereupon gas-knives are arranged to blow off any surplus of molten metal from the steel sheet. A plurality of sensors are arranged adjacent the electromagnets to detect the position of the steel sheet in relation to the predetermined transport path. Further, said sensors are all arranged within the minimum width of the steel sheet, by which is meant the smallest sheet width that is to be run in the plant. The electromagnets are adapted to apply a magnetic force to the sheet, for the purpose of reducing vibrations arising in said sheet, in dependence on the detected position of the steel sheet in a direction substantially perpendicular to the predetermined transport path. Because the vibrations are reduced, the rate of production may increase while at the same time the degree of surplus coating of the coating material, which is based on the smallest coating thickness and aims at compensating for the vibrations, can be reduced, which leads to reduced consumption of coating material. Another advantage achieved by the reduction of the vibrations is that the distance between the gas-knives and the steel sheet may be reduced in order thus to obtain increased wiping-off power, thus allowing a thinner layer to be applied onto the sheet with a retained rate of production.

According to one embodiment of the invention, at least three sensors are located in a plane parallel to the transport direction of the sheet and further with the sensing direction of the transducers perpendicular to the transport direction of the sheet located on both sides of the steel sheet. In addition, said sensors are arranged within the minimum width of the steel sheet. The at least three sensors are suitably arranged inside the electromagnets, preferably with one sensor inside each electromagnet. By means of this embodiment, the sensors will be located at a minimum distance from the cores of the electromagnets, which in turn is advantageous in view of the control of the current through the coils.

According to one embodiment of the invention, at least three sensors are located in a plane parallel to the transport direction of the sheet and further with the sensing direction of the transducers perpendicular to the transport direction of the sheet located on both sides of the steel sheet. In addition, these sensors are arranged within the minimum width of the steel sheet. The at least three sensors are suitably arranged in close proximity to the electromagnets, preferably with one sensor adjacent to each electromagnet. This embodiment minimizes the risks of the control of the current through the coils being disturbed because of the distance between the sensors and the electromagnets.

According to one embodiment of the invention, at least one of the sensors is movably arranged in a direction essentially perpendicular to the transport direction and parallel to the plane of the sheet, such that the position of the sensors may be adapted to the width of the steel sheet. With such an embodiment of the invention, it will be easy to adjust the plant for different widths of the sheet in an optimal manner. At least one sensor may also be movable in a direction essentially perpendicular to the predetermined transport path to adjust the sensors at a suitable distance from the sheet. The sensors are, for example, inductive transducers or laser transducers for distance measuring.

According to one embodiment of the invention, a measuring device for measuring the thickness of the metal layer at several points along the width of the steel sheet is arranged downstream of the gas-knife, and the information from the measurement of the thickness of the layer is used to control the position and the shape of the sheet with the electromagnets such that the desired thickness of the layer in the width direction of the steel sheet is obtained. This embodiment provides a possibility of adapting the distribution of the zinc thickness in the width direction of the sheet so as to obtain a uniform distribution.

According to one embodiment of the invention, the device comprises signal-processing equipment that processes the signals from the sensors. From the signal-processing equipment, the information about the measured deviations passes on to control equipment comprising a converter that controls the current flowing to the coils in the electromagnets based on the deviations, measured by the sensors, between the steel sheet and the predetermined transport path. This embodiment provides the necessary control loop that is required to enable adaptation of a suitable magnetic force that influences the sheet at all instants.

According to one embodiment of the invention, the control equipment also controls the current to the coils in the electromagnets based on at least one of the following process parameters: sheet thickness, layer thickness, sheet width, sheet speed, joints and tensile stress in the steel sheet. Also data from the gas-knives, such as for example the pressure on the gas from the gas-knives or the distance between gas-knife and steel sheet, may be used for controlling the current to the coils in the electromagnets. When the thickness of the sheet is known, this embodiment facilitates the control of the current to the coils.

The object of the invention is also achieved by means of a method for stabilizing an elongated steel sheet.

According to one embodiment of the invention, the current to the coils in the electromagnets is controlled in dependence on the detected position of the steel sheet.

According to one embodiment of the invention, a frequency analysis of vibrations in the steel sheet is carried out based on the detected position of the steel sheet. By means of this embodiment, the operators receive information about future maintenance requirements which indicates whether there are any poor bearings or other defects in the process.

According to one embodiment of the invention, the position of the steel sheet between the electromagnets is controlled by means of a fixed basic current that is fed to the coils of the electromagnets so that an offset position is imparted to the sheet in relation to the uninfluenced position of the sheet during operation. By this embodiment, the vibrations of the sheet are reduced without the natural position of the sheet being influenced.

BRIEF DESCRIPTION OF THE DRAWINGS

The invention will be explained in greater detail by description of embodiments with reference to the accompanying drawings, wherein FIG. 1 schematically shows the electromagnets in a device for stabilizing a steel sheet.

DESCRIPTION OF PREFERRED EMBODIMENTS

Figure 1:
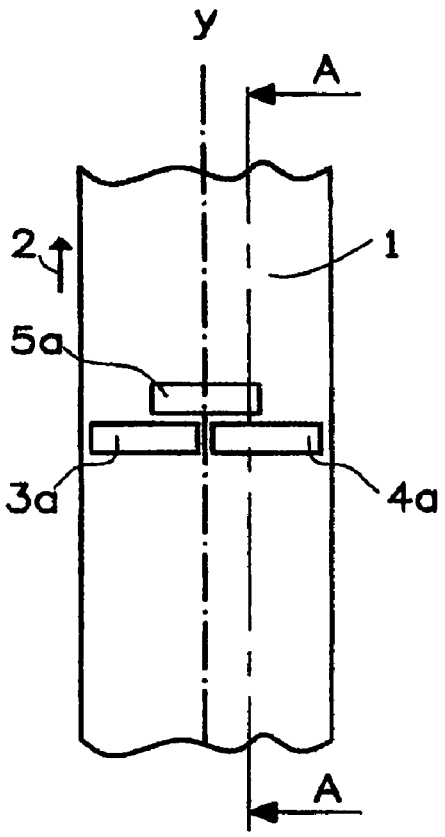
Figure 2:
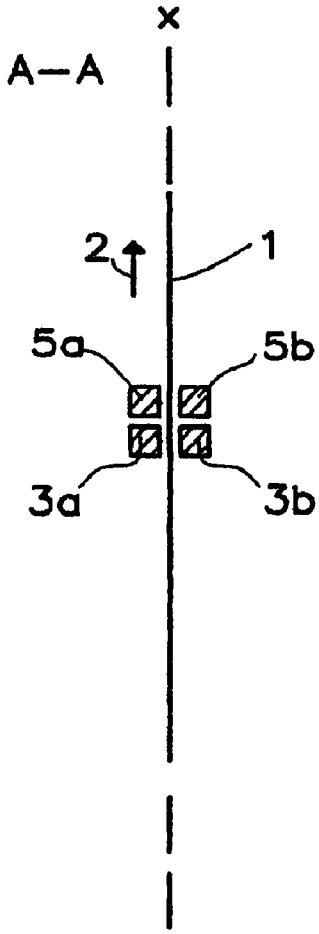
FIG. 2 shows a cross section A-A of the device of FIG. 1, FIG. 3 schematically shows the device according to FIG. 1 when stabilizing a narrower steel sheet, FIG. 4 schematically shows the device according to FIG. 3 when stabilizing a narrower steel sheet, compared with the steel sheet in FIG. 3, and the third electromagnet arranged upstream of the first and second electromagnets, FIG. 5 schematically shows how the third elongated electromagnet is arranged in an extent substantially in a transport direction of the sheet, FIG. 6 schematically shows how the third electromagnet is arranged between the first and second electromagnets, FIG. 7 schematically shows stabilization of a steel sheet in a process line for coating the sheet with a layer of metal.

FIGS. 1 and 2 schematically show a device for stabilizing an elongated steel sheet 1 when continuously transporting the steel sheet in a transport direction 2 along a predetermined transport path (x), wherein FIG. 2 is a cross section of FIG. 1. The device comprises a first, a second a third pair of electromagnets, 3*a*, 3*b*, 4*a*, 4*b*, 5*a*, 5*b* which are adapted to stabilize the steel sheet 1 with respect to the predetermined transport path (x). Each pair of electromagnets 3*a*, 3*b*, 4*a*, 4*b*, 5*a*, 5*b* comprises one electromagnet on each side of the steel sheet 1. FIG. 2 shows a cross section of the first pair and the third pair of electromagnets 3*a*, 3*b*, 5*a*, 5*b* along section A-A in FIG. 1. A first and a second electromagnet 3*a*, 3*b*, 4*a*, 4*b* are elongated in a direction essentially perpendicular to the trans-port direction 2 and arranged on respective sides of a longitudinal centre line (y) for the steel sheet 1, wherein the centre line is essentially parallel to the transport direction 2. The third electromagnet 5*a*, 5*b* is elongated and arranged in its longitudinal direction essentially transversely to the transport direction and over the centre line (y) of the steel sheet. In FIG. 1, the third electromagnet 5*a*, 5*b* is arranged, in the transport direction, downstream of the first and the second electromagnet 3*a*, 3*b*, 4*a*, 4*b*. The first and second electromagnets 3*a*, 3*b*, 4*a*, 4*b* are located in line with each other essentially perpendicular to the transport direction. So that the electromagnets should suit most widths of sheet, the length of the electromagnets lies in the interval of 300-1000 mm, preferably in the interval of 400-700 mm.

Figure 3:
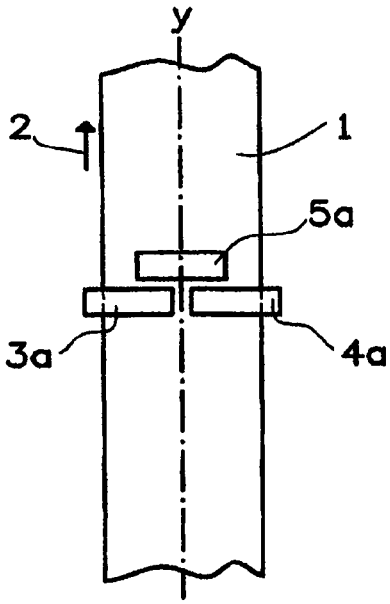
Figure 4:
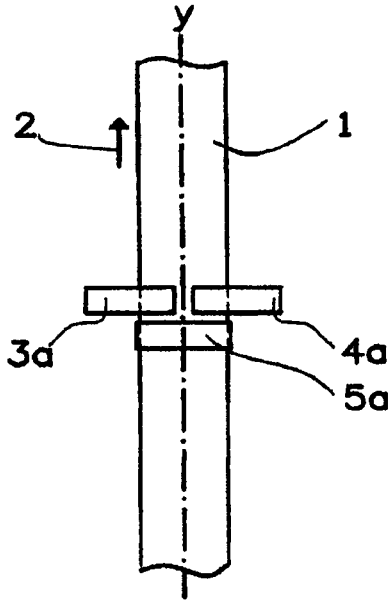

FIG. 3 shows the same configuration of electromagnets 3*a*, 4*a*, 5*a* as in FIGS. 1 and 2 for a narrower width of steel sheet and on one side of the steel sheet. FIG. 4 shows the electromagnets 3*a*, 4*a*, 5*a* for a still narrower width of sheet than in FIG. 3, with the difference that the third electromagnet 5*a* is arranged upstream of the first and second electromagnets 3*a*, 4*a*.

Figure 5:
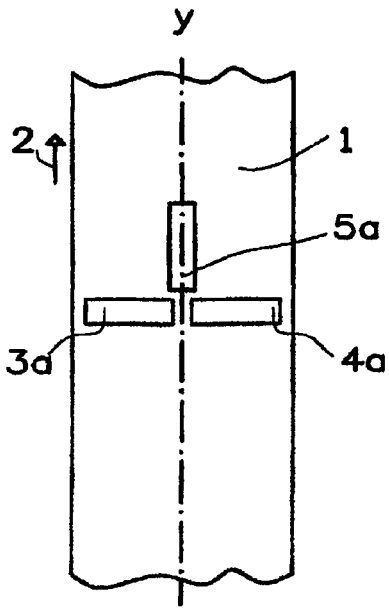

FIG. 5 shows how the third electromagnet 5*a* is elongated and extends in its longitudinal direction essentially along the transport direction 2, and adjacent to the centre line, preferably in the centre line (y). The third electromagnet 5*c* is arranged, in the transport direction, downstream of the first and second electromagnets 3*a*, 4*a*.

Figure 6:
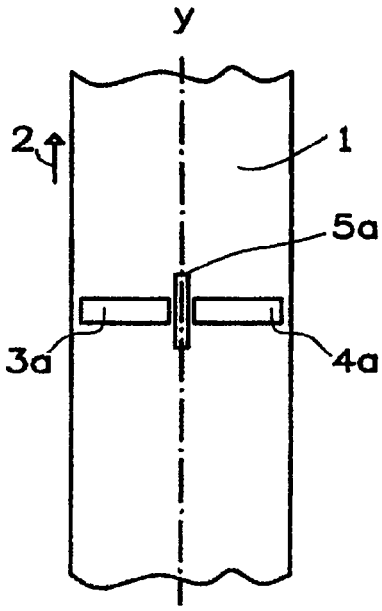

FIG. 6 schematically shows how the third electromagnet 5*a* is arranged between the first and second electromagnets 3, 4 with its long side substantially parallel to the centre line of the sheet. The third electromagnet 5*a* is elongated and extends in its longitudinal direction essentially along the transport direction 2 and adjacent to the centre line, preferably in the centre line (y).

Figure 7:
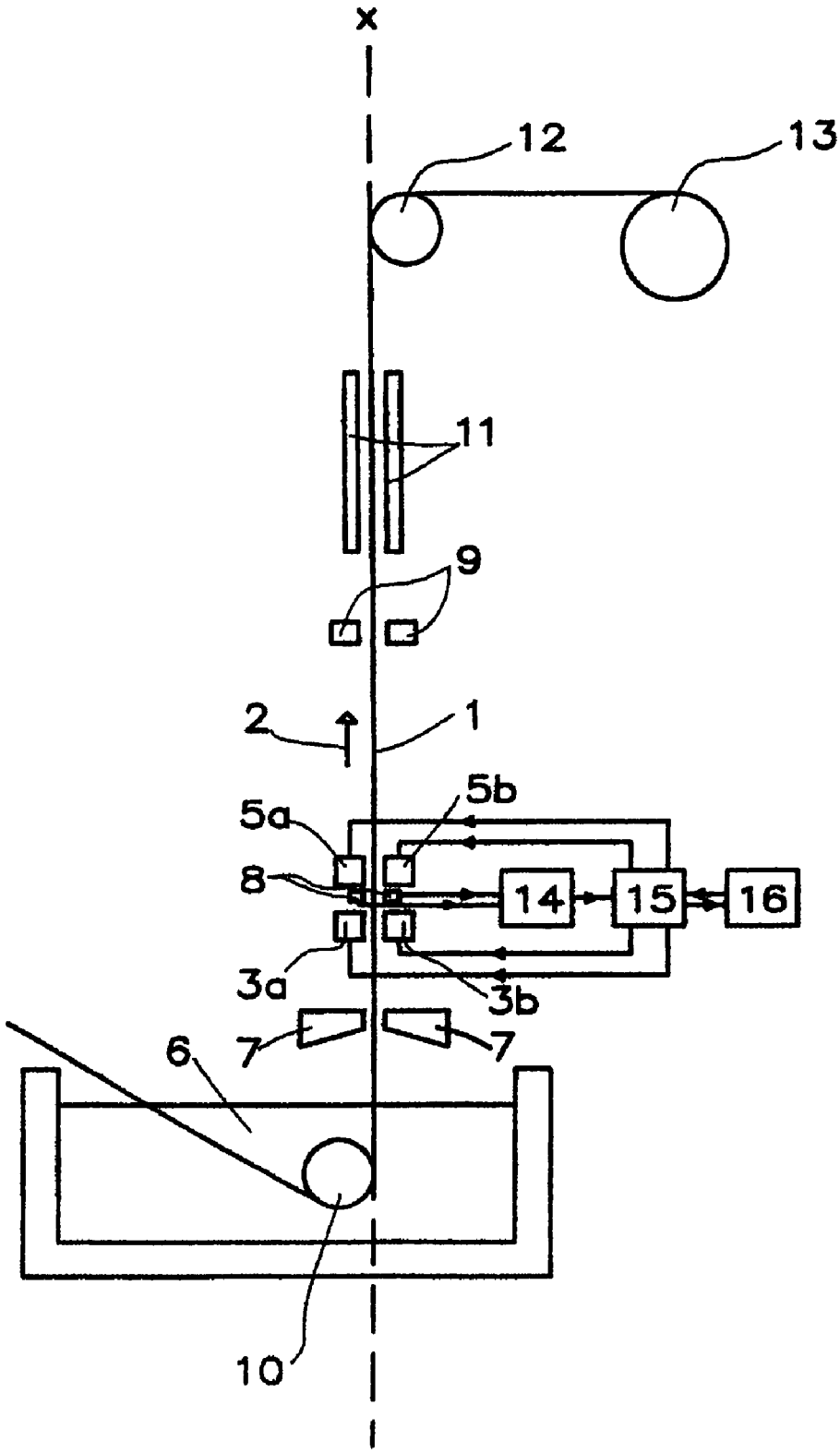

FIG. 7 shows the electromagnets 3*a*, 3*b*, 4*a*, 4*b*, 5*a*, 5*b* in a process line for coating the steel sheet 1 with a metallic layer, for example a zinc layer. The metallic layer is applied by continuously transporting the steel sheet 1 through a bath 6 of zinc. In the bath 6, the steel sheet usually passes below an immersed roller 10 and thereafter moves vertically upwards through stabilizing and correcting rollers (not shown). The steel sheet leaves the bath 6 and is conveyed through a set of gas-knives 7, which blow away superfluous zinc from the steel sheet and back to the bath in order to control the thickness of the coating. The steel sheet is then transported without support until the coating has been cooled down and solidified. After the gas-knives 7, the electromagnets 3*a*, 3*b*, 4*a*, 4*b*, 5*a*, 5*b* are arranged, and at the electromagnets, sensors 8 are arranged for sensing the deviation from the plane (x). The signals from the sensors 8 are processed in signal-processing equipment 14, and control equipment 15 comprising a converter controls the current passing to the electromagnets 3*a*, 3*b*, 4*a*, 4*b*, 5*a*, 5*b* for stabilizing the sheet. Downstream of the electromagnets, cooling elements 9 are arranged. The coated steel sheet is then led or directed via an upper roller 12 for continued treatment of the steel sheet, as for example cutting of the sheet into separate sheet elements, or for winding the sheet onto a roller 13. In normal cases, the sheet moves in a vertical direction from the roller 10 immersed into the bath through the correcting and stabilizing rollers and the gas-knives to the upper roller 13.

According to one embodiment, the control equipment 15 carries out frequency analysis of vibrations in the steel sheet 1 based on the detected position of the steel sheet. The status and condition of at least one of the following: the frequency analyses of vibrations in the steel sheet, different modes of vibration occurring in the steel sheet, statistics from the process, history of the process, and proposals for changes of the process parameters, are presented on a control panel 16.

According to another embodiment, the position of the steel sheet between the electromagnets 3*a*, 3*b*, 4*a*, 4*b*, 5*a*, 5*b* is adjusted in order to achieve that, on average, the same amount of current is fed to the coils of the electromagnets in at least one of the pairs of electromagnets. The adjustment is performed such that both coils are moved simultaneously, in the same direction and the same distance, and the steel sheet 1 is centred between the electromagnets.

The position of the sensors in relation to the predetermined transport path (x) is calibrated according to an embodiment in case of a stationary steel sheet 1.

According to yet another embodiment, the sensors 8 measure the distance to the predetermined transport path 1 and adjust, where necessary, the position of the electromagnets 3*a*, 3*b*, 4*a*, 4*b*, 5*a*, 5*b* in a direction essentially perpendicular to the predetermined transport path (x), and in relation to the steel sheet (1) so that the desired distance between the electromagnets and the steel sheet is obtained.

Figure 8:
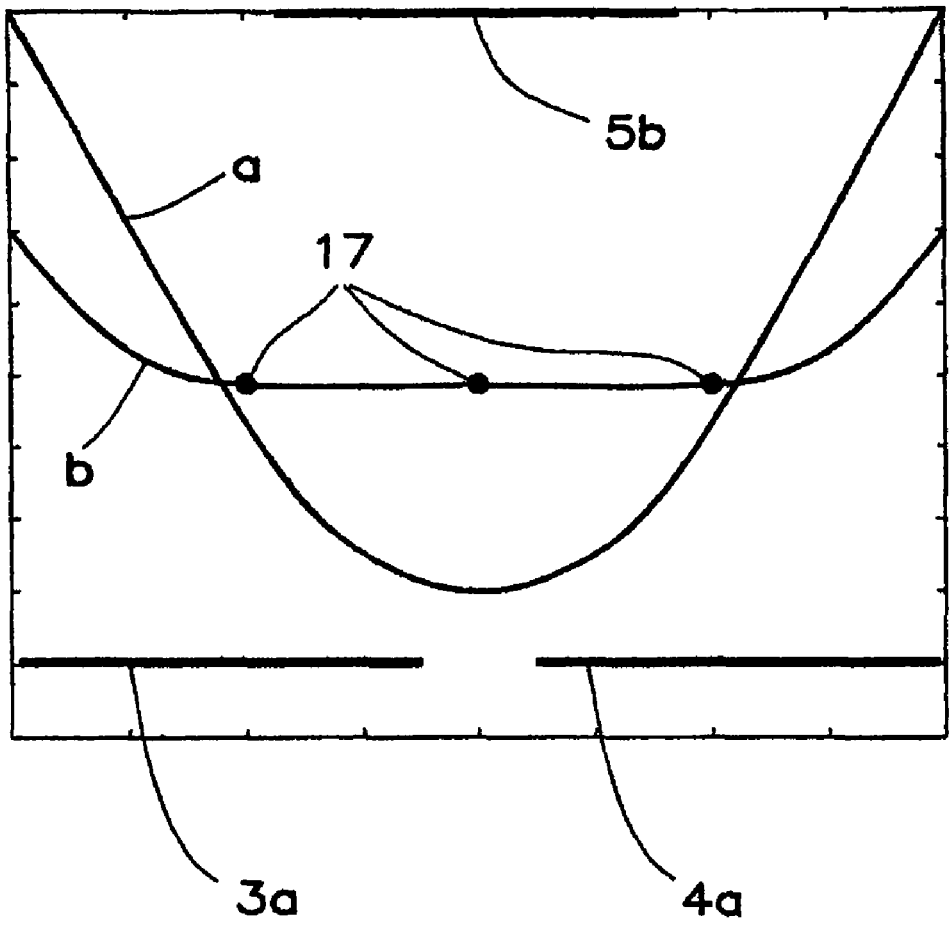
FIG. 8 shows a cross section of a steel sheet with and without stabilizing forces from electromagnets according to the location of FIG. 1.

FIG. 8 shows an example of the shape of a steel sheet in a cross section, with and without stabilizing forces from the electromagnets according to the location in FIG. 1. The cross section passes in a plane perpendicular to the predetermined transport path. The deflection of the sheet relative to a reference line midway between the magnets is measured at three positions 17 along the width of the sheet. The figure shows how a curved static deformation for a sheet, curve a, that is not subjected to stabilizing forces, is formed from stabilizing magnetic forces from the electromagnets 3*a*, 4*a*, 5*b* so that the deviation of the sheet at positions 17 is zero, curve b. The figure also shows in which configuration the electromagnets are arranged along the width of the sheet. Only one magnet 3*a*, 4*a*, 5*b* from each pair of electromagnets, that is, the magnet that is currently active, is drawn out in the figure.

The invention is not limited to the embodiments shown but a person skilled in the art may, of course, modify it in a plurality of ways within the scope of the invention as defined by the claims. For example, the invention is not limited to steel sheet that has been coated with molten metal but may also be used for non-coated steel sheet. The device according to the invention may, for example, be arranged in all positions in a sheet-processing line where vibrations occur or where there is a need of shaping the sheet. The steel sheet may also be stabilized according to the invention when the steel sheet is transported in a horizontal direction.

The invention claimed is:

1. A device for stabilizing an elongated steel sheet when continuously transporting the steel sheet in a transport direction along a predetermined transport path, the device comprises:

a first pair, a second pair and a third pair of electromagnets with at last one electromagnet on each side of the steel sheet, which are adapted to stabilize the steel sheet with respect to the predetermined transport path, wherein the first and second pairs of electromagnets are elongated in a direction essentially perpendicular to the transport direction, wherein the first and second pairs of electromagnets are arranged in line with each other essentially perpendicular to the transport direction, wherein the first and second pairs of electromagnets are substantially arranged on each side of a longitudinal center line for the steel sheet, wherein the longitudinal center line is essentially parallel to the transport direction, wherein the third pair of electromagnets is arranged adjacent to the longitudinal center line, wherein the third pair of electromagnets is elongated, wherein a longitudinal axis of the third pair of electromagnets extends in a direction transverse to the transport direction over the longitudinal center line or extends along the transport direction in the longitudinal center line, and wherein the length of the electromagnets lies within the interval 300-1000 mm.

2. The device according to claim 1, wherein the third pair of electromagnets, in the transport direction, is arranged upstream or downstream of the first and second pairs of electromagnets.

3. The device according to claim 1, wherein the third pair of electromagnets has a length that at least partly overlaps the length of the first and second pairs electromagnets transversely to the transport direction.

4. The device according to claim 1, wherein the third pair of electromagnets is arranged between the first and second pairs of electromagnets.

5. The device according to claim 1, wherein the length of at least one of the electromagnets lies within the interval 400-700 mm.

6. The device according to claim 1, wherein the device is arranged in a process line for coating of the steel sheet with a metallic layer, whereby said metallic layer is applied by continuously transporting the steel sheet through a bath of molten metal, whereupon gas-knives are arranged to blow away surplus of molten metal from the steel sheet.

7. The device according to claim 6, wherein a measuring device for measuring the thickness of the metal layer at several points along the width of the steel sheet is arranged downstream of the gas-knife, and the information from the measurement of the thickness of the metallic layer is used for controlling the shape or position of the steel sheet with the electromagnets so that the desired thickness of the metallic layer in the width direction of the steel sheet is obtained.

8. The device according to claim 1, wherein a plurality of sensors are arranged adjacent to the electromagnets and arranged within a minimum width of the steel sheet for detecting the position of the steel sheet in relation to the predetermined transport path, and the electromagnets are adapted to apply a magnetic force to the steel sheet in dependence on the detected position of the steel sheet in a direction substantially perpendicular to the predetermined transport path.

9. The device according to claim 8, wherein at least one of the sensors is movably arranged in a direction substantially perpendicular to the transport direction and parallel to a plane of the steel sheet.

10. The device according to claim 1, wherein a plurality of sensors are arranged inside the electromagnets or in the vicinity of the electromagnets for detecting the position of the steel sheet in relation to the predetermined transport path, wherein the electromagnets are adapted to apply a magnetic force to the steel sheet in dependence on the detected position of the steel sheet in a direction substantially perpendicular to the predetermined transport path.

11. The device according to claim 1, further comprising:

control equipment configured to control a current to the electromagnets in dependence on measured deviations between the steel sheet and the predetermined transport path.

12. The device according to claim 11, wherein the control equipment also controls the current to the electromagnets based on at least one of the following process parameters: sheet thickness, layer thickness, sheet width, sheet speed, joints, and tensile stress in the steel sheet.

13. A method for stabilizing an elongated steel sheet, the method comprising:

transporting the steel sheet in a transport direction along a predetermined transport path, stabilizing the position of the steel sheet with respect to the predetermined transport path in that at least a first pair, a second pair, and a third pair of electromagnets with at least one electromagnet on each side of the steel sheet, where necessary, apply a magnetic force to the steel sheet, wherein the first and second pairs of electromagnets are elongated and extend in a direction essentially perpendicular to the transport direction so as to be arranged in a line with each other and are arranged on each side of a longitudinal center line for the steel sheet, wherein said center line being essentially parallel to the transport direction, wherein the third electromagnet is arranged adjacent to the longitudinal center line, wherein the third pair of electromagnets is elongated, wherein a longitudinal axis of the third pair of electromagnets extends essentially transversely to the transport direction and over the longitudinal center line of the steel sheet or extends essentially along the transport direction and in the longitudinal center line.

14. The method according to claim 13, wherein the steel sheet is coated with a metallic layer wherein the steel sheet is continuously transported through a bath of molten metal, whereupon gas-knives blow away any surplus of molten metal from the steel sheet.

15. The method according to claim 13, wherein a plurality of sensors arranged adjacent to the electromagnets detect the position of the steel sheet in relation to the predetermined transport path, and the electromagnets apply a magnetic force to the steel sheet in dependence on the detected position of the steel sheet in a direction substantially perpendicular to the predetermined transport path.

16. The method according to claim 15, wherein the current to the electromagnets is controlled in dependence on the detected position of the steel sheet.

17. The method according to claim 13, wherein the current to the electromagnets is controlled in dependence on one or more of the following process parameters: sheet thickness, layer thickness, sheet width, sheet speed, joints, and tensile stress in the steel sheet.

18. The method according to claim 13, wherein a frequency analysis of vibrations in the steel sheet is carried out based on the detected position of the steel sheet.

19. The method according to claim 13, wherein the distance of the electromagnets to the steel sheet is adjusted to ensure, on average, that the same amount of current is fed to the electromagnets, in at least one of the pairs of electromagnets, so that the steel sheet is centered between the electromagnets.

20. The method according to claim 13, further comprising: galvanizing the steel sheet.

* * * * *